US008006742B2

(12) United States Patent
Nakayama et al.

(10) Patent No.: US 8,006,742 B2
(45) Date of Patent: Aug. 30, 2011

(54) CASTING ROLL

(75) Inventors: Katsumi Nakayama, Tokyo (JP); Hiroyuki Otsuka, Tokyo (JP); Hisahiko Fukase, Yokohama (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 12/527,773

(22) PCT Filed: Feb. 22, 2008

(86) PCT No.: PCT/JP2008/000301

§ 371 (c)(1),
(2), (4) Date: Oct. 15, 2009

(87) PCT Pub. No.: WO2008/105154

PCT Pub. Date: Sep. 4, 2008

(65) Prior Publication Data

US 2010/0108284 A1 May 6, 2010

(30) Foreign Application Priority Data

Feb. 26, 2007 (JP) ..... 2007-045518

(51) Int. Cl.
*B22D 11/12* (2006.01)

(52) U.S. Cl. ..... 164/448; 164/428

(58) Field of Classification Search ..... 164/428, 164/448

See application file for complete search history.

(56) References Cited

U.S. PATENT DOCUMENTS

| | | | | |
|---|---|---|---|---|
| 5,996,680 | A * | 12/1999 | Fukase et al. | 164/428 |
| 6,241,002 | B1 | 6/2001 | Russell et al. | |
| 2007/0017651 | A1 * | 1/2007 | Otsuka et al. | 164/448 |

FOREIGN PATENT DOCUMENTS

| | | |
|---|---|---|
| JP | 62-45456 | 2/1987 |
| JP | 11-57952 | 3/1999 |
| JP | 11-314138 | 11/1999 |
| JP | 2007-29967 | 2/2007 |

* cited by examiner

*Primary Examiner* — Jessica L Ward
*Assistant Examiner* — Nicholas P D'Aniello
(74) *Attorney, Agent, or Firm* — Oblon, Spivak, McClelland, Maier & Neustadt, L.L.P.

(57) ABSTRACT

A casting roll having an outer periphery capable of being efficiently cooled is disclosed. The casting roll has a roll body on which side weirs abut, short tube-shaped supports each coaxially with and protruding from the roll body, a stub axle fitted into the support, a sleeve fitted over the support and a flange contiguous with the stub axle and abutting on the sleeve on a side away from the roll body. The roll body is formed with longitudinal cooling passages passing through the roll from one end to the other end of the roll as well as radial cooling passages each adjacent to a corresponding end of the roll and extending from an inner periphery of the roll to a corresponding longitudinal cooling passage. A plug is fitted into each end of the longitudinal cooling passages and abuts on the sleeve. With a distance between the longitudinal cooling passages and the outer periphery of the roll body being reduced as much as possible, cooling water is passed through a portion of the roll body.

4 Claims, 6 Drawing Sheets

CASTING ROLL

TECHNICAL FIELD

The present invention relates to a casting roll.

BACKGROUND ART

Known as one of techniques for directly producing a strip from molten metal is twin-roll continuous casting where molten metal is supplied to between a pair of rotated rolls to deliver a solidified metal strip.

FIGS. 1 and 2 show a continuous casting machine with conventional casting rolls, each casting roll comprising a cylindrical roll body 2 on which side weirs 1 abut, and hollow stub axles 3 fitted into opposite ends of the roll body 2, respectively (see, for example, Patent Literature 1).

The roll body 2 is shaped such that the opposite ends have an outer diameter smaller than that of an intermediate portion. The side weirs 1 abut on end surfaces of the lager-diameter intermediate portion.

The roll body 2 is formed with a plurality of longitudinal cooling passages 4 located circumferentially equidistantly and extending axially of the roll body, and a plurality of radial cooling passages 5 extending radially of an roll axis and communicating with corresponding ends of the longitudinal passages 4, respectively.

The longitudinal passage 4 passes through the roll from a portion of one of the end surfaces of the roll on which one of the side weirs 1 does not abut to a portion of the other end of the roll on which the other side weir 1 does not abut. Fitted into each end of the longitudinal passage is a plug 6 or a bolt 7 serving as plug to connect the stub axle 3 to the roll body 2.

The radial passage 5 passes from an inner periphery of the roll near end of the roll, at a right angle, into the longitudinal cooling passage 4.

The stub axles 3 is formed with radial cooling passages 8 such that cooling water W continuously flows through one of the radial passages 5 with which the longitudinal passage 4 communicates, the longitudinal passage 4 and the other radial passage 5 with which the same longitudinal passage 4 communicates, in the order named. For the radial passages 8, for example, a rotary joint is incorporated.

The continuous casting machine comprises the paired casting rolls each constituted by the above-mentioned roll body 2 and stab axles 3. The rolls are horizontally juxtaposed such that a nip between the rolls is adjusted to be increased/decreased depending on thickness of a strip S to be produced. The side weirs 1 surface-contact one and the other end surfaces of the larger-diameter intermediate portions of the roll body 2, respectively.

Rotational directions and velocities of the casting rolls are set such that respective outer peripheries of the rolls are moved from above toward the nip G at constant velocity.

In the continuous casting machine, molten metal is poured into space defined by the side weirs 1 and roll bodies 2 to provide molten metal pool M while heat is removed from the roll body 2 by flow of cooling water W through the radial and longitudinal passages 5 and 4. With the casting rolls rotated, metal is cooled on the outer peripheries of the roll bodies 2 into solidified shells, a resultant strip S being delivered from the nip downward.

At so-called triple point regions where the roll body 2, the side weir 1 and the molten metal pool M meet, the solidified shell may be extraordinarily produced.

Any solidified shell produced at the triple point region may be dragged and peeled by the solidified shell formed on the outer periphery of the roll body 2 and may be bitten at the nip, which brings about not only defective shape of the locally thickened strip S but also flaring or expansion of the nip due to the defective portion of the strip, resulting in reduction in cooling efficiency, fracture of the strip S due to reheating from the molten metal and damage on the side weirs 1 upon drop-out of the solidified shell.

In order to overcome these, it has been proposed a continuous casting machine in which molten metal is directed to the side weirs 1 and is aggressively poured tangentially of the roll bodies 2 to prevent unnecessary solidified shells from being produced at the triple point regions (see, for example, Patent Literature 2).

In the above technique, the hot molten metal just poured may pass along the side weirs 1 to reach the nip within an extremely short time, resulting in scrimpy thickness of the solidified shell at axial end vicinities of the roll body 2 especially upon production of strip S with thickness of the order of 2 mm.

[Patent Literature 1] JP 11-314138A

[Patent Literature 2] JP 62-45456A

SUMMARY OF INVENTION

Technical Problems

In the continuous casting machine shown in FIGS. 1 and 2, enhancement of roll revolution to increase production of the strip S requires reduction of a distance T1 between the longitudinal cooling passages 4 and the outer periphery of the roll body 2 to enhance capability of cooling the molten metal on the outer periphery of the roll body 2.

However, the more the above-mentioned distance T1 is reduced, the more a contact distance T2 of the side weir 1 on the end surface of the larger-diameter portion of the roll body 2 is reduced, resulting in failure of providing the molten metal pool M.

The invention was made in view of the above and has its object to provide a casting roll having an outer periphery capable of being efficiently cooled.

Solution to Problems

In order to attain the above objects, a first aspect of the invention comprises a cylindrical roll body with axial end marginal portions on which side weirs abut, short tube-shaped supports each coaxially with and protruding from said roll body, a stub axle fitted into said support, a sleeve fitted over said support and a flange contiguous with said stub axle and abutting on the sleeve on a side away from said roll body, said roll body being formed with longitudinal cooling passages passing through the roll from one end to the other end of the roll as well as radial cooling passages each adjacent to a corresponding end of the roll and extending from an inner periphery of the roll to a corresponding longitudinal cooling passage, a plug being fitted into each end of the longitudinal cooling passages and abutting on said sleeve, whereby cooling water can flow through one of the radial cooling passages, the longitudinal cooling passage and the other radial cooling passage in the order named.

Specifically, the roll body is formed with the longitudinal cooling passages passing through the roll body from one of the opposite ends of the roll where one of the side weirs abuts on one of the axial end marginal portions to the other end of the roll where the other side weir abuts on the other axial end marginal portion, with a distance being reduced between the longitudinal cooling passages and an outer periphery of the roll body.

Further, the roll body is formed with the radial cooling passages each adjacent to the corresponding end of the roll and extending from the inner periphery of the roll to the corresponding longitudinal cooling passage, the cooling water being guided to the plugs fitted into the ends of the longitudinal cooling passages, the plug being held by the sleeve and the flange of the stub axle.

A second aspect of the invention comprises a cylindrical roll body with axial end marginal portions on which side weirs abut, stub axles each fitted to said roll body and a flange contiguous with said stub axle and facing to a corresponding end of the roll body, said roll body being formed with longitudinal cooling passages passing through the roll from one end to the other end of the roll as well as radial cooling passages each adjacent to a corresponding end of the roll and extending from an inner periphery of the roll to a corresponding longitudinal cooling passage, a plug being fitted into each end of the longitudinal cooling passages and abutting on said flange, whereby cooling water can flow through one of the radial cooling passages, the longitudinal cooling passage and the other radial cooling passage in the order named.

Specifically, the roll body is formed with the longitudinal cooling passages passing through the roll body from one of the opposite ends of the roll where one of the side weirs abuts on one of the axial end marginal portions to the other end of the roll where the other side weir abuts on the other axial end marginal portion, with a distance being reduced between the longitudinal cooling passages and an outer periphery of the roll body.

Further, the roll body is formed with the radial cooling passages each adjacent to the corresponding end of the roll and extending from the inner periphery of the roll to the corresponding longitudinal cooling passage, the cooling water being guided to the plugs fitted into the longitudinal cooling passage, the plug being held by the flange of the stub axle.

Advantageous Effects of Invention

A casting roll according to the invention can exhibit the following effects and advantages.

(1) In either of the first and second aspects of the invention, the longitudinal cooling passages pass through the roll body from one end of the roll on which one of the side weirs abuts to the other end of the roll on which the other side weir abuts, so that the distance can be reduced between the longitudinal cooling passages and the outer periphery of the roll body to effectively cool the outer periphery of the roll body.

(2) In either of the first and second aspects of the invention, the cooling water is directly in contact with the plugs and the end inner peripheries of the longitudinal cooling passages, so that end vicinities of the outer periphery of the roll body can be more effectively cooled.

(3) In the first aspect of the invention, the plugs fitted into the ends of the longitudinal cooling passages are held by the sleeve and flange of the stub axle. As a result, even if the plugs are reduced in size axially of the roll, the plugs are not deformed by the pressure of the cooling water, the cooling water being prevented from leaking.

(4) In the second aspect of the invention, the plugs fitted into the ends of the longitudinal cooling passages are held by the flange of the stub axle. As a result, even if the plugs are reduced in size axially of the roll, the plugs are not deformed by the pressure of the cooling water, the cooling water being prevented from leaking.

(5) In either of the first and second aspects of the invention, the outer periphery of the roll body can be satisfactorily cooled. As a result, for example, the revolution of the roll body can be enhanced to enhance production efficiency of strip. If there is no need of enhancing the revolution of the roll body, the flow rate of the cooling water may be reduced, which contributes to simplification of ancillary facilities such as pump, piping or cooler and thus reduction in pumping power.

REFERENCE SIGNS LIST

Figure 1:
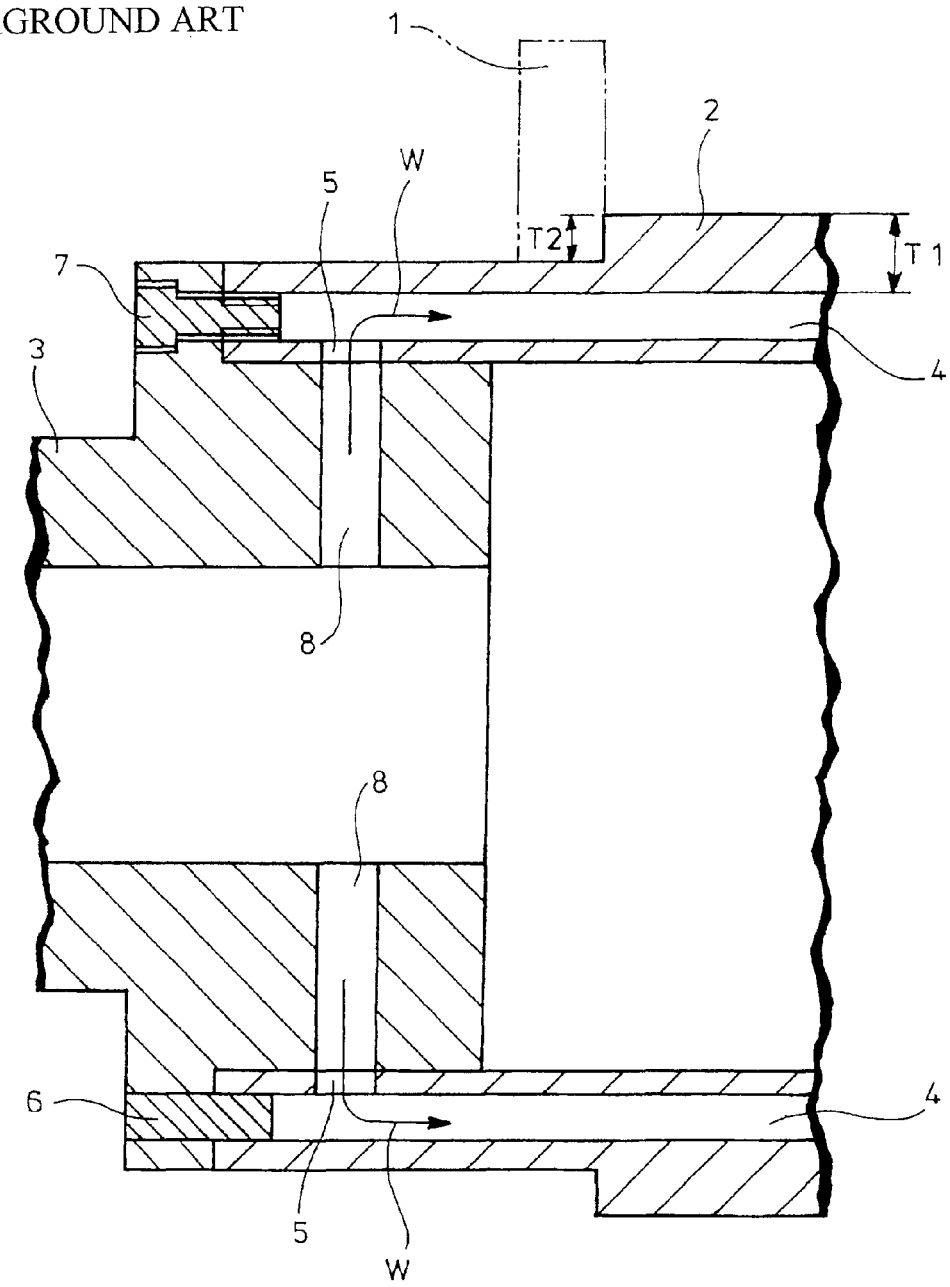
FIG. 1 BACKGROUND ART
FIG. 1 is a schematic view showing in longitudinal section important parts of a continuous casting machine with conventional casting rolls.
Figure 2:
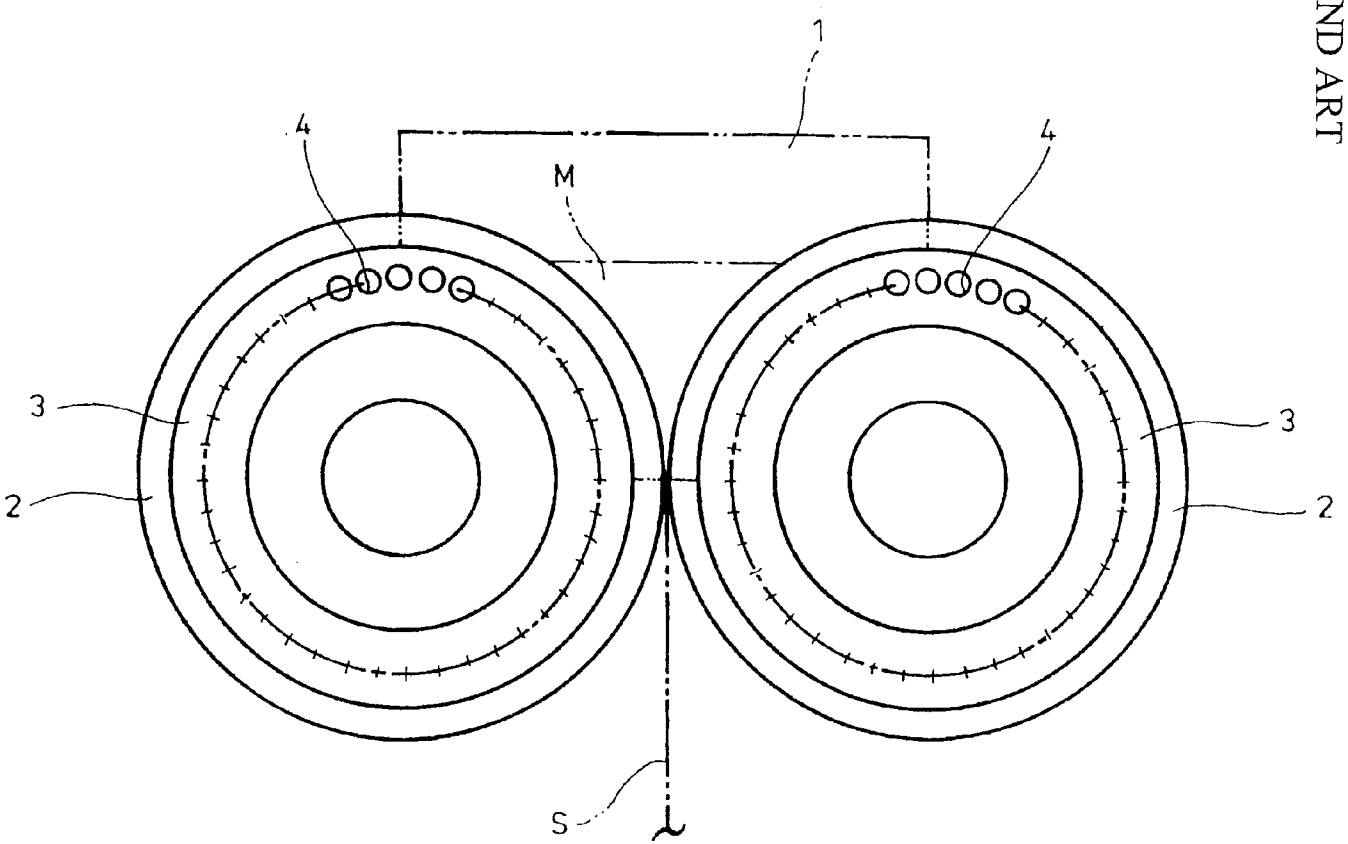
FIG. 2 BACKGROUND ART
FIG. 2 is a schematic view axially showing the roll bodies and stub axles in connection with FIG. 1.

11 side weir
12 roll body
13 support
14 stub axle
15 sleeve
16 flange
17 longitudinal cooling passage
18 radial cooling passage
19 plug
23 side weir
24 roll body
25 stub axle
26 flange
27 longitudinal cooling passage
28 radial cooling passage
29 plug
W cooling water

DESCRIPTION OF EMBODIMENTS

Embodiments of the invention will be described in conjunction with the drawings.

Figure 3:
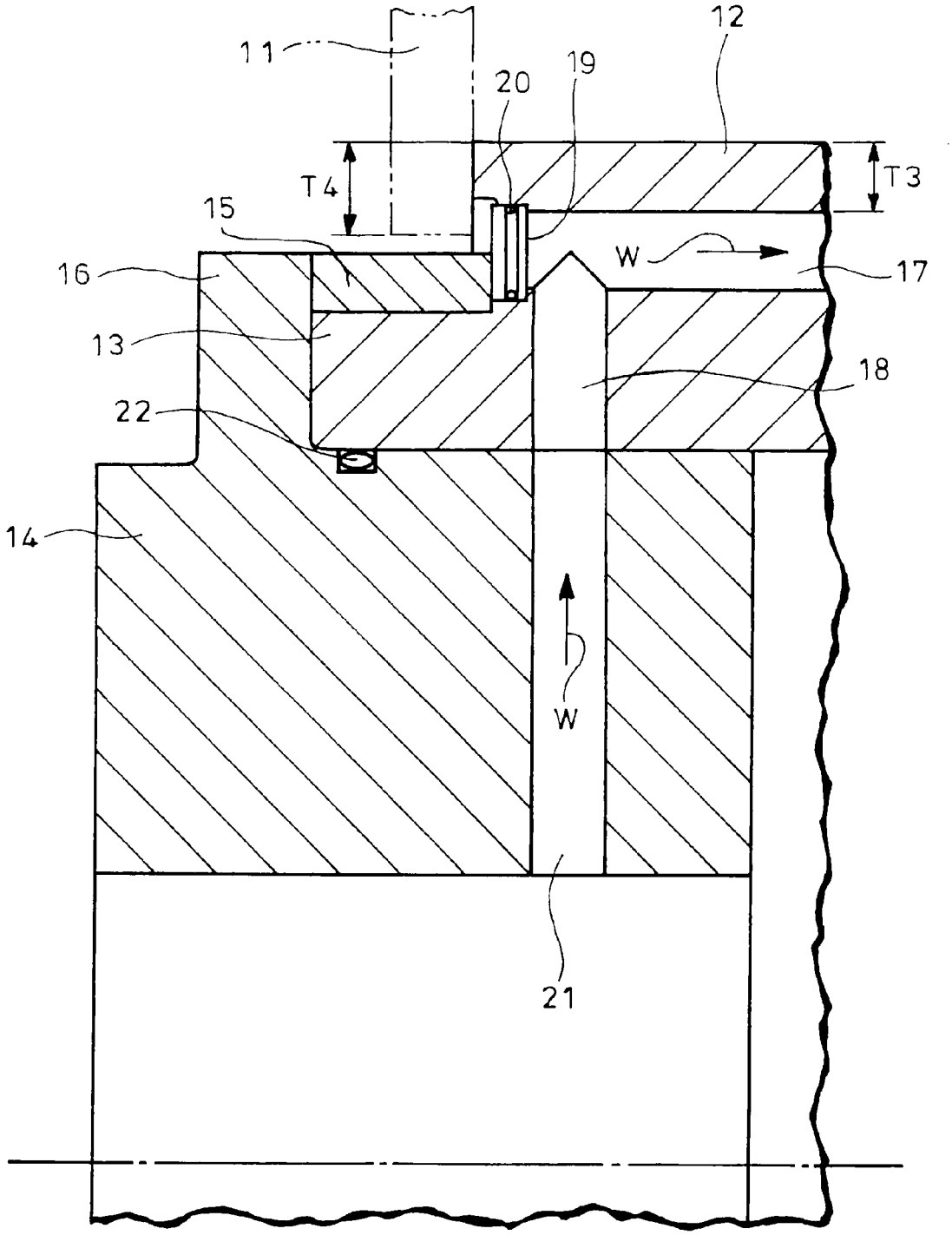
FIG. 3 is a schematic view showing in longitudinal section important parts of a continuous casting machine with casting rolls according to a first embodiment of the invention.
Figure 4:
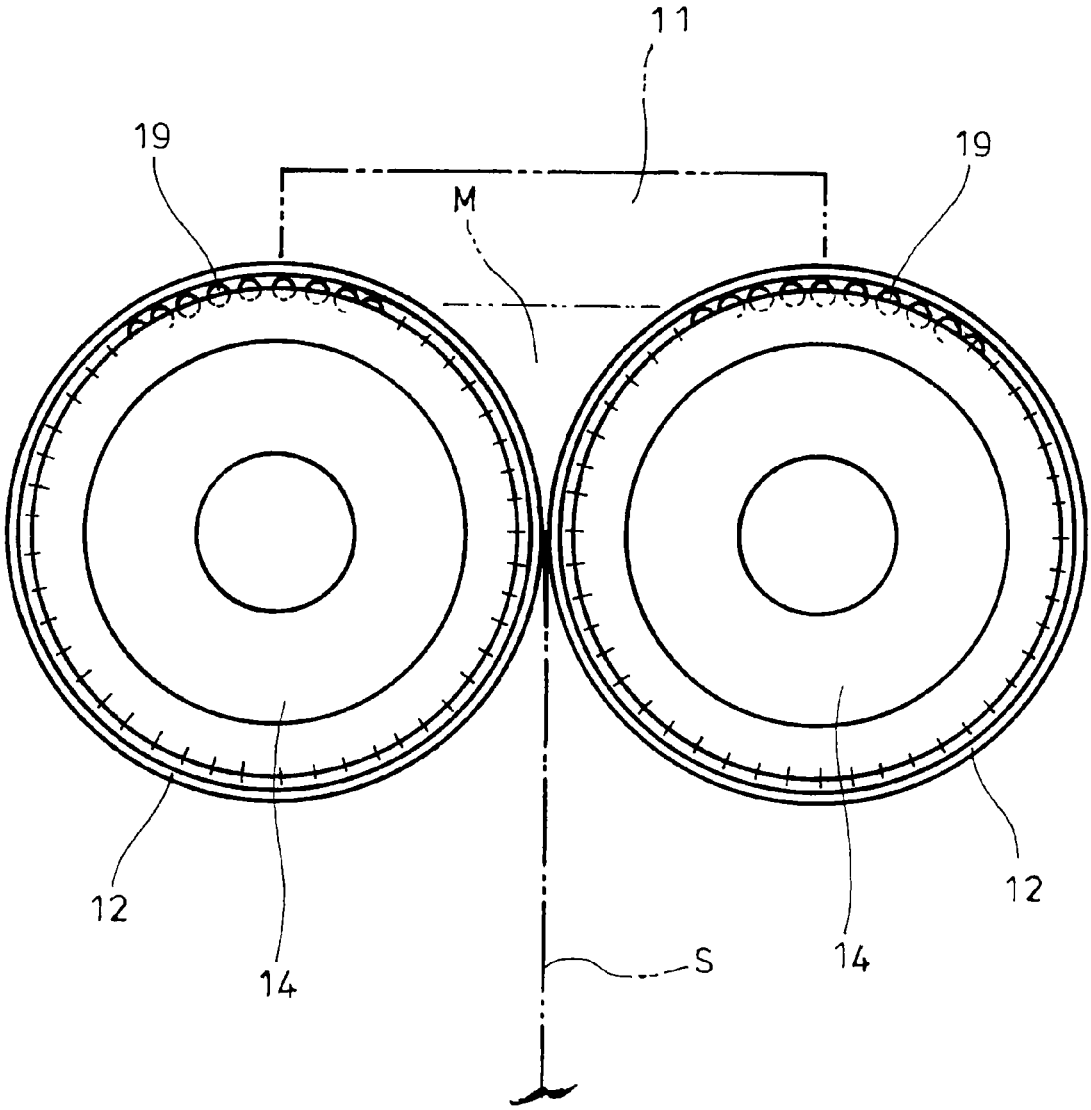
FIG. 4 is a schematic view axially showing the roll bodies and stub axles in connection with FIG. 3.

FIGS. 3 and 4 show a continuous casting machine with casting rolls of a first embodiment of the invention. Each of the casting rolls comprises a cylindrical roll body 12 with axial ends having marginal portions on which side weirs 11 abut, short tube-shaped supports 13 each coaxially protruding from the roll body 12, a stub axle 14 fitted into the support 13, a sleeve 15 fitted over the support 13 and a flange 16 contiguous with the stub axle 14 and abutting on the sleeve 15 on a side away from the roll body 12.

The roll body 12 is formed with longitudinal cooling passages 17 passing through the roll from one end of the roll to the other end of the roll and radial cooling passages 18 each located near a corresponding end of the roll and passing from an inner periphery of the roll to a corresponding longitudinal cooling passage 17.

The longitudinal cooling passages 17 are located circumferentially equidistantly of the roll body 12 and the radial cooling passages 18 extend radially of an axis of the roll body 12.

Moreover, a disc-like plug 19 is fitted into each end of the longitudinal cooling passages 17 so as to abut on a corresponding sleeve 15.

A sealing member 20 such as O-ring is fitted between the plug 19 and the inner periphery of the longitudinal cooling passage 17, the cooling water continuously flowing through one of the radial cooling passages 18 communicating with the longitudinal cooling passage 17, the longitudinal cooling passage 17 and the other radial cooling passage 18 communicating with the same longitudinal cooling passage 17, in the order named.

The stub axle 14 is hollow and formed with radial cooling passages 21 communicating with the radial cooling passages 18 of the roll body 12.

For the radial cooling passages 21, a rotary joint is incorporated for communication of the cooling water with outside of the casting roll.

Fitted between the outer periphery of the stub axle 14 and the inner periphery of the support 13 are sealing members 22 such as O-ring, the flange 16 being bolted to the support 13.

When the roll is a newly produced one, the axial end marginal portions of the roll body 12 are protruded ahead of the plugs 19 toward the side weirs 11 with expected wear being taken into consideration.

The continuous casting machine comprises the paired casting rolls each constituted for example by the roll body 12, the stub axles 14 and the plugs 19. The rolls are horizontally juxtaposed side by side such that a nip between the rolls is adjusted to be increased/decreased depending on thickness of a strip S to be produced. The side weirs 11 surface-contact the marginal portions of one and the other axial end surfaces of the roll body 12.

Rotational directions and velocities of the casting rolls 1 are set such that respective outer peripheries of the rolls are moved from above toward the nip G at constant velocity.

In the continuous casting machine, molten metal is poured into space defined by the side weirs 1 and the roll bodies 2 to provide molten metal pool M while heat is removed from the roll body 12 by flow of the cooling water W through the radial and longitudinal passages 18 and 17. With the casting rolls rotated, metal is cooled on the outer peripheries of the roll bodies 12 into solidified shells, a resultant strip S being delivered from the nip downward.

The longitudinal cooling passages 17 passing through the roll body 12 extend from one end surface of the roll with the marginal portion on which one of the side weirs 11 abuts to the other end surface on which the other side weir 11 abuts, so that even if the distance T3 between the longitudinal cooling passage 17 and the outer periphery of the roll body 12 is reduced as much as possible, contact distance T4 of the side weir 11 to the roll body 12 is ensured.

Thus, the cooling water W passes through a surficial portion of the roll body 12 to effectively cool the outer periphery of the roll body 12.

Moreover, the cooling water W directly contacts the plugs 19 and end inner peripheries of the longitudinal cooling passages 17, so that end vicinities of the outer periphery of the roll body 12 can be cooled more effectively.

The plug 19 fitted into the end of the longitudinal cooling passage 17 is held by the sleeve 15 and the flange 16 of the stub axle 14, so that the plug 19 is not deformed by the pressure of the cooling water W even if the thickness of the plug 19 is reduced, the cooling water W being prevented from leaking.

Thus, the casting rolls shown in FIGS. 3 and 4 has sufficient cooling effects on outer periphery of roll body 12, so that revolution of the roll body 12 and thus casting velocity can be enhanced to enhance production efficiency of the strip S.

Figure 5:
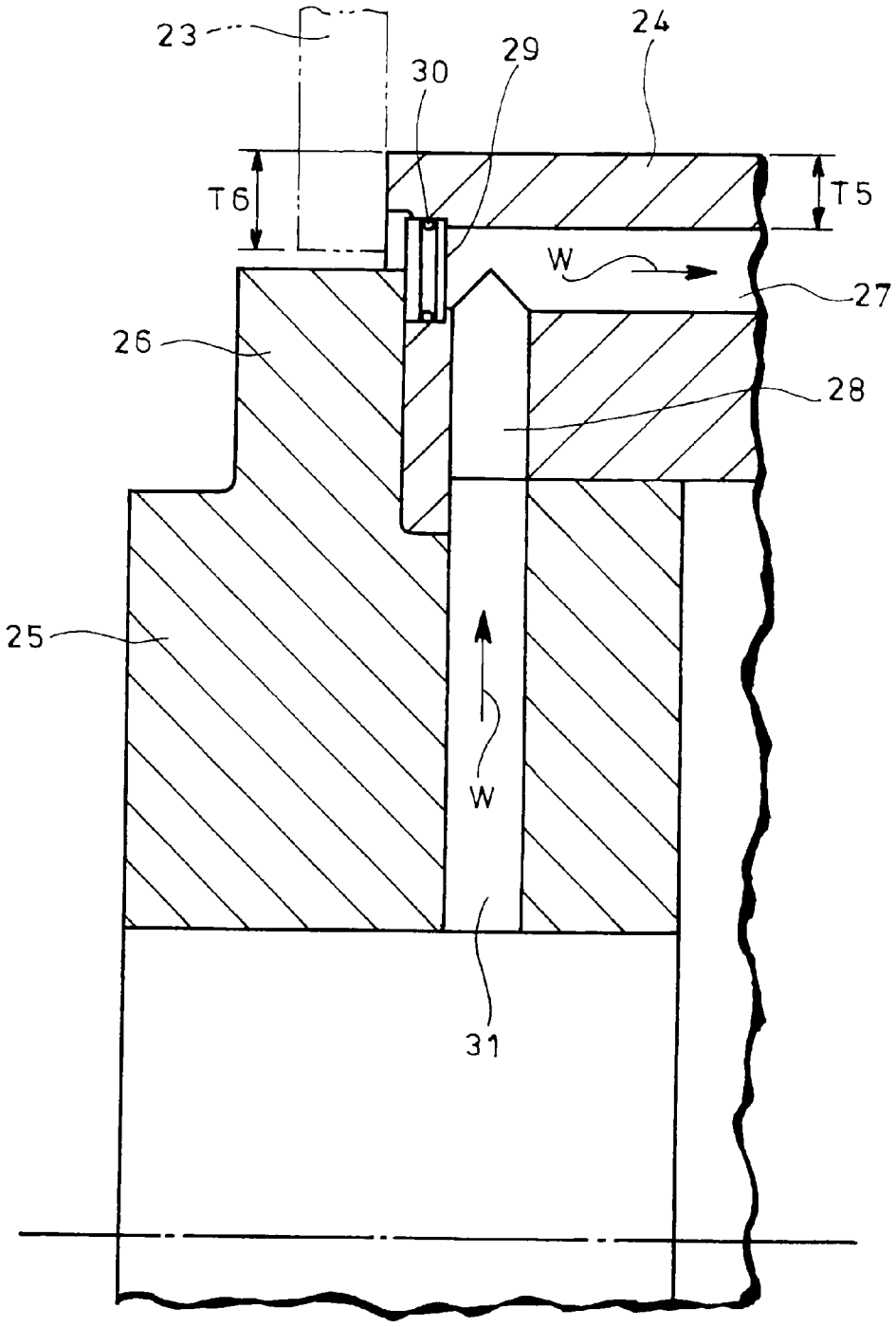
FIG. 5 is a schematic view showing in longitudinal section important parts of a continuous casting machine with casting rolls according to a second embodiment of the invention.
Figure 6:
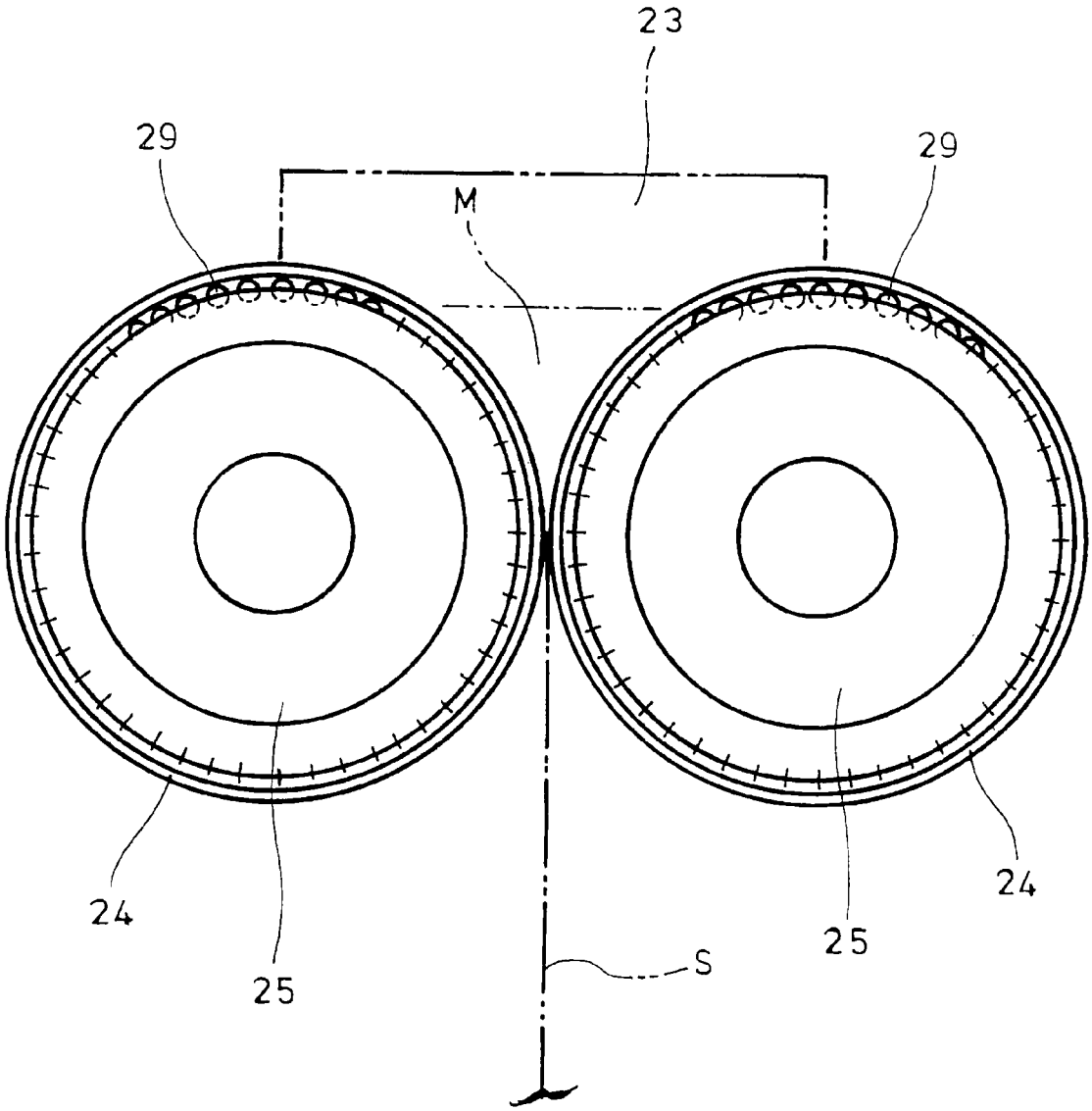
FIG. 6 is a schematic view axially showing the roll bodies and stub axles in connection with FIG. 5.

FIGS. 5 and 6 show a continuous casting machine with casting rolls according to a second embodiment of the invention. Each of the casting roll comprises a cylindrical roll body 24 with axial end marginal portions on which side weirs 23 abut, stub axles 25 each fitted into the roll body 24 and a flange 26 contiguous with the stub axle 25 and facing to the corresponding end of the roll body 24.

The roll body 24 is formed with longitudinal cooling passages 27 passing from one end to the other end of the roll and radial cooling passages 28 each located near a corresponding end of the roll and leading from an inner periphery of the roll to a corresponding longitudinal cooling passage 27.

The longitudinal cooling passages 27 are located circumferentially equidistantly of the roll body 24 and the radial cooling passages 28 extend radially of an axis of the roll body 24.

Further, fitted into each end of the longitudinal cooling passages 27 is a disk-like plug 29 so as to abut on the flange 26.

Fitted between the plug 29 and inner periphery of the longitudinal cooling passage 27 is a sealing member 30 such as O-ring, the cooling water W continuously flowing through one of the radial cooling passages 28 communicating with the longitudinal cooling passage 27, the longitudinal cooling passage 27 and the other radial cooling passage 28 communicating with the same longitudinal cooling passage 27, in the order named.

The stub axle 25 is hollow and formed with radial cooling passages 31 continuous with the radial cooling passages 28 of the roll body 24.

For the radial cooling passages 31, a rotary joint is incorporated for communication of the cooling water with outside of the casting rolls.

Fitted between an end of the flange 26 of the stub axle 25 and an end of the roll body 24 is a sealing member 30 such as O-ring, the flange 26 being bolted to the roll body 24.

When the roll is a newly produced one, the axial end marginal portions of the roll body 24 are protruded ahead of the plug 29 toward the side weirs 23 with expected wear being taken into consideration.

The continuous casting machine comprises the paired casting rolls each constituted by for example the roll body 24, the stub axles 25 and the plugs 29. The rolls are horizontally juxtaposed such that a nip between the rolls is adjusted to be increased/decreased depending on thickness of a strip S to be produced. The side weirs 23 surface-contact one and the other axial end marginal portions of the roll body 24.

Rotational directions and velocities of the casting rolls are set such that respective outer peripheries of the rolls are moved from above toward the nip at constant velocity.

In the continuous casting machine, molten metal is poured into space defined by the side weirs 23 and the roll bodies 24 to provide molten metal pool M while heat is removed from the roll body 24 by flow of cooling water W through the radial and longitudinal passages 28 and 27. With the casting rolls rotated, metal is cooled on the outer peripheries of the roll bodies 24 into solidified shells, a resultant strip S being delivered from the nip downward.

The longitudinal cooling passages 27 passing through the roll body 24 extend from one end of the roll with the marginal portion on which one of the side weirs 23 abuts to the other end with the marginal portion on which the other side weir 23 abuts, so that even if the distance T5 between the longitudinal cooling passages 27 and the outer periphery of the roll body 24 is reduced as much as possible, contact distance T6 of the side weir 23 to the roll body 24 is ensured.

Thus, the cooling water W pass through a surficial part of the roll body 24 to effectively cool the outer periphery of the roll body 24.

Moreover, the cooling water W directly contacts the plugs 29 and end inner peripheries of the longitudinal cooling passages 27, so that end vicinities of outer periphery of the roll body 24 can be cooled more effectively.

The plug 29 fitted into the end of the longitudinal cooling passage 27 is held by the flange 26 of the stub axle 25, so that the plug 29 is not deformed by the pressure of the cooling water W even if the thickness of the plug 29 is reduced, the cooling water W being prevented from leaking.

Thus, the casting roll shown in FIGS. 5 and 6 has satisfactory cooling effect on the outer periphery of roll body 24, so that revolution of the roll body 24 and thus casting velocity can be enhanced to enhance production efficiency of the strip S.

It is to be understood that a casting roll of the invention is not limited to the above embodiments and that various changes and modifications may be made without departing from the scope of the invention.

INDUSTRIAL APPLICABILITY

A casting roll of the invention may be used for continuous casting of steel or a variety of other metals.

The invention claimed is:

1. A casting roll, comprising:

a cylindrical roll body with axial end marginal portions;

side weirs abutting the axial end marginal portions of said roll body;

a short tube-shaped support coaxially protruding from said roll body;

a stub axle fitted into said support;

a sleeve fitted over said support; and a flange contiguous with said stub axle and abutting on the sleeve on a side away from said roll body, wherein said roll body is formed with longitudinal cooling passages passing through the roll from one end to the other end of the roll only within a range between said side weirs, and radial cooling passages each adjacent to a corresponding end of the roll and extending from an inner periphery of the roll to a corresponding longitudinal cooling passage, wherein a plug is fitted into each end of the longitudinal cooling passages and abuts on said sleeve such that said plug is disposed between one of the ends of said longitudinal cooling passages and one of said side weirs in a direction parallel to the axis of said roll body, whereby cooling water can flow through one of the radial cooling passages, the longitudinal cooling passage and the other radial cooling passage in the order named, and wherein a radial contact distance between said side weirs and said roll body is greater than a radial distance between said longitudinal cooling passages and an outer periphery of said roll body.

2. The casting roll as claimed in claim 1, wherein a first axial face of the sleeve abuts the plug and a second axial face of the sleeve abuts the flange.

3. The casting roll as claimed in claim 1, wherein a first sealing member is fitted between the plug and an inner periphery of the longitudinal cooling passage.

4. The casting roll as claimed in claim 1, wherein a second sealing member is fitted between an inner periphery of the support and an outer periphery of the stub axle.

* * * * *